US010847952B2

(12) United States Patent
Ochiai

(10) Patent No.: US 10,847,952 B2
(45) Date of Patent: Nov. 24, 2020

(54) PROCESSING APPARATUS, METHOD FOR MANUFACTURING MOLDED PRODUCT, AND METHOD FOR MANUFACTURING SPARK PLUG ELECTRODE

(71) Applicant: NGK SPARK PLUG CO., LTD., Nagoya (JP)

(72) Inventor: Satoru Ochiai, Nagakute (JP)

(73) Assignee: NGK SPARK PLUG CO., LTD., Nagoya-shi (JP)

( * ) Notice: Subject to any disclaimer, the term of this patent is extended or adjusted under 35 U.S.C. 154(b) by 356 days.

(21) Appl. No.: 15/808,056

(22) Filed: Nov. 9, 2017

(65) Prior Publication Data

US 2018/0138667 A1 May 17, 2018

(30) Foreign Application Priority Data

Nov. 11, 2016 (JP) ..... 2016-220822

(51) Int. Cl.
*B21K 21/08* (2006.01)
*H01T 21/02* (2006.01)
(Continued)

(52) U.S. Cl.
CPC ..... *H01T 21/02* (2013.01); *B21D 28/14* (2013.01); *B21J 9/022* (2013.01); *B21K 21/08* (2013.01); *H01T 13/16* (2013.01)

(58) Field of Classification Search
CPC ..... B21D 22/025; B21D 22/28; B21D 43/05; B21D 45/006; B21D 45/06; B21D 45/08;
(Continued)

(56) References Cited

U.S. PATENT DOCUMENTS 1,310,122 A * 7/1919 Leighton et al. ..... B21C 23/217 72/265
2,762,108 A 9/1956 Friedman
(Continued)

FOREIGN PATENT DOCUMENTS

EP 0044764 1/1982
JP T-2005-519772 A 7/2005
(Continued)

OTHER PUBLICATIONS

Extended European Search Report issued in corresponding European Patent Application No. 17200369.1, dated Mar. 12, 2018.
(Continued)

*Primary Examiner* — Edward T Tolan
(74) *Attorney, Agent, or Firm* — Kusner & Jaffe

(57) ABSTRACT

A processing apparatus for processing a workpiece by transferring the workpiece between a ram and a die block. At least one recessed die of a plurality of dies molds the workpiece into a bottomed tubular shape by a punch. A punch, among a plurality of punches, that has entered the recessed die exits from the recessed die with the formed workpiece being attached to the punch, together with the workpiece. Since the workpiece is transferred from the die block to the ram when the punch exits from the die, a step of moving the ram forward relative to the die block to transfer the workpiece from the die block to the ram can be omitted accordingly.

2 Claims, 14 Drawing Sheets

(51) Int. Cl.

| | |
|---|---|
| ***H01T 13/16*** | (2006.01) |
| ***B21J 9/02*** | (2006.01) |
| ***B21D 28/14*** | (2006.01) |

(58) Field of Classification Search
CPC ..... B21D 28/14; B21J 9/022; B21K 21/08; B21K 21/10; B21K 21/14
See application file for complete search history.

(56) References Cited

U.S. PATENT DOCUMENTS 3,783,670 A * 1/1974 Nickrawietz ..... B21D 43/05 72/346
4,562,719 A * 1/1986 Budrean ..... B21D 51/54 72/349
4,870,846 A * 10/1989 Budrean ..... B21D 17/02 72/77
2004/0182209 A1 9/2004 Franco et al.
2006/0196330 A1 9/2006 Franco et al.
2007/0000114 A1 1/2007 Franco et al.
2008/0302162 A1 12/2008 Franco et al.

FOREIGN PATENT DOCUMENTS

JP 2015-003328 A 1/2015
JP B1-5603459 1/2015
WO WO 2004/014620 A1 2/2004

OTHER PUBLICATIONS

Office Action issued in corresponding Japanese Patent Application No. 2016-220822 dated Jul. 21, 2020.

* cited by examiner

PROCESSING APPARATUS, METHOD FOR MANUFACTURING MOLDED PRODUCT, AND METHOD FOR MANUFACTURING SPARK PLUG ELECTRODE

RELATED APPLICATIONS

This application claims the benefit of Japanese Patent Application No. 2016-220822, filed Nov. 11, 2016, the entire contents of which are incorporated herein by reference.

FIELD OF THE INVENTION

The present invention relates to a processing apparatus, a method for manufacturing a molded product, and a method for manufacturing a spark plug electrode.

BACKGROUND OF THE INVENTION

A center electrode of a spark plug is a rod-shaped electrode obtained by embedding, in an electrode base material formed in the bottomed tubular shape, a core material having higher thermal conductivity than the electrode base material. The electrode base material is made by performing plastic working on a workpiece obtained by cutting a wire rod. As a processing apparatus for a workpiece, a technique disclosed in Japanese Patent No. 5603459 is known. The processing apparatus (former) disclosed in Japanese Patent No. 5603459 includes a die block in which a plurality of dies are aligned at a predetermined pitch, and a ram in which a plurality of punches opposing the dies are aligned at a predetermined pitch. The die block reciprocates on a pitch-by-pitch basis relative to the ram, and the ram repeatedly moves forward and backward relative to the die block.

The processing apparatus processes a workpiece by performing a manufacturing process in many stages so as to gradually change the shape of the workpiece into a final shape. First, the ram moves forward relative to the die block, and thereafter, a load is applied to the workpiece by the punches and the dies. Then, the ram moves backward relative to the die block holding the workpiece, and thereafter, the die block moves in one direction of reciprocation by one pitch. Next, the ram moves forward relative to the die block, and thereafter, the workpiece is transferred from the die to the ram. Then, the ram holding the workpiece moves backward relative to the die block, and thereafter, the die block moves in the other direction of reciprocation by one pitch. The ram again moves forward relative to the die block again, and thereafter, a load is applied to the workpiece by the punch and the die. By repeating this cycle, the workpiece is processed.

According to the above-described conventional technique, the ram moves forward relative to the die block on two occasions during one cycle. On one of the occasions, the workpiece is processed by the punches and the dies applying a load to the workpiece. However, on the other occasion, the workpiece is transferred from the die block to the ram without being processed, resulting in a problem of a longer machining process.

The present invention has been made to address the above-described problem, and an advantage of the invention is a processing apparatus, a method for manufacturing a molded product, and a method for manufacturing a spark plug electrode that can shorten a working process.

SUMMARY OF THE INVENTION

In accordance to a first aspect of the present invention, there is provided a processing apparatus that includes a cutting portion that cuts a wire rod to produce a workpiece, a die block in which a plurality of dies that receive the workpiece are arranged so as to be spaced apart from each other, and a ram in which a plurality of punches that oppose the plurality of dies are arranged so as to be spaced apart from each other. A first moving portion relatively moves the ram and the die block in a first direction in which the dies and the punches are arranged, and a second moving portion relatively advances and retracts the ram and the die block in a second direction intersecting the first direction. The processing apparatus processes the workpiece by transferring the workpiece between the ram and the die block.

At least one recessed die of the plurality of dies molds the workpiece into a bottomed tubular shape by the corresponding punch. The punch, among the plurality of punches, that has entered the recessed die exits from the recessed die with the molded workpiece being attached to the punch, together with the workpiece. Since the workpiece is transferred from the die block to the ram when the punch exits from the die, a step of moving the ram forward relative to the die block to transfer the workpiece from the die block to the ram can be omitted accordingly. Therefore, the effect of shortening the working process is provided.

According to a second aspect of the present invention, there is provided a processing apparatus, wherein a round portion is formed at an edged portion at a bottom of the workpiece by a corner portion of the recessed die. Accordingly, any material that has moved during molding of the workpiece can easily flow into a clearance between the outer periphery of the punch and the inner periphery of the recessed die. As a result, a material flow that causes the workpiece to tighten the punch occurs. Since the workpiece can be easily attached to the punch, it is possible to provide, in addition to the effect of the first aspect, the effect of allowing the workpiece to easily exit from the recessed die together with the punch.

According to a third aspect of the present invention, there is provided a processing apparatus, wherein the ram includes a movable stripper that is disposed on an outer periphery of the punch, among the plurality of punches, that enters the recessed die. The movable stripper is in a retracted state when the punch enters the recessed die to mold the workpiece. Accordingly, it is possible to prevent the movable stripper from adversely affecting molding of the workpiece. The movable stripper advances toward a tip of the punch when the punch enters the die that is different from the recessed die, with the workpiece being attached to the punch. Accordingly, it is possible to remove the workpiece from the punch, and place the workpiece in the die. Thus, in addition to the effect provided by the first or second aspect, the effect of enhancing the design freedom of the working process is provided.

A method for manufacturing a molded product according to a fourth aspect of the invention and a method for manufacturing a spark plug electrode according to a fifth aspect of the invention provide the same effect as that provided by the first aspect.

DETAILED DESCRIPTION OF THE INVENTION

Figure 1:
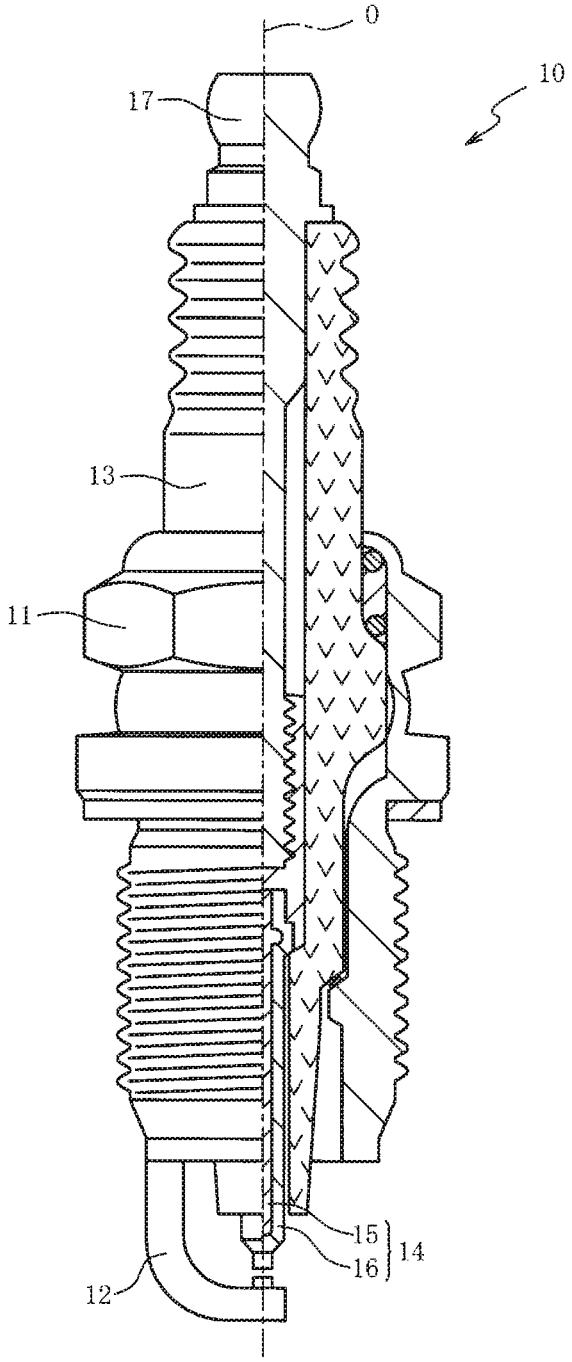
FIG. 1 is a half cross-sectional view of a spark plug.

Hereinafter, a preferred embodiment of the present invention will be described with reference to the accompanying drawings. FIG. 1 is a half cross-sectional view taken an axial line O of a spark plug 10 as a boundary. In FIG. 1, the lower side of the plane of paper is referred to as the front side of the spark plug 10, and the upper side of the plane of paper is referred to as the rear side of the spark plug 10. As shown in FIG. 1, the spark plug 10 includes a metal shell 11, an insulator 13, and a center electrode 14.

The metal shell 11 is a substantially cylindrical member that is fixed to an internal combustion engine (not shown), and is formed of a metal material (e.g., low-carbon steel) having conductivity. A ground electrode 12 is electrically connected to the metal shell 11.

The insulator 13 is a substantially cylindrical member formed of alumina or the like having excellent mechanical characteristics and insulation properties under high temperatures. The insulator 13 is inserted in the metal shell 11, and the metal shell 11 is fixed to the outer circumference thereof.

The center electrode 14 is a rod-shaped electrode obtained by embedding, in an electrode base material 16 formed in the bottomed tubular shape, a core material 15 made of a metal (e.g., copper) having higher thermal conductivity than the electrode base material 16. The electrode base material 16 is formed of a metal material (e.g., a nickel-based alloy) having conductivity. The center electrode 14 is held by the insulator 13.

A metal terminal 17 is a rod-shaped member to which a high-voltage cable (not shown) is connected, and is attached to the insulator 13. The metal terminal 17 is formed of a metal material (e.g., low-carbon steel) having conductivity, and is electrically connected to the center electrode 14 inside the insulator 13.

Figure 2:
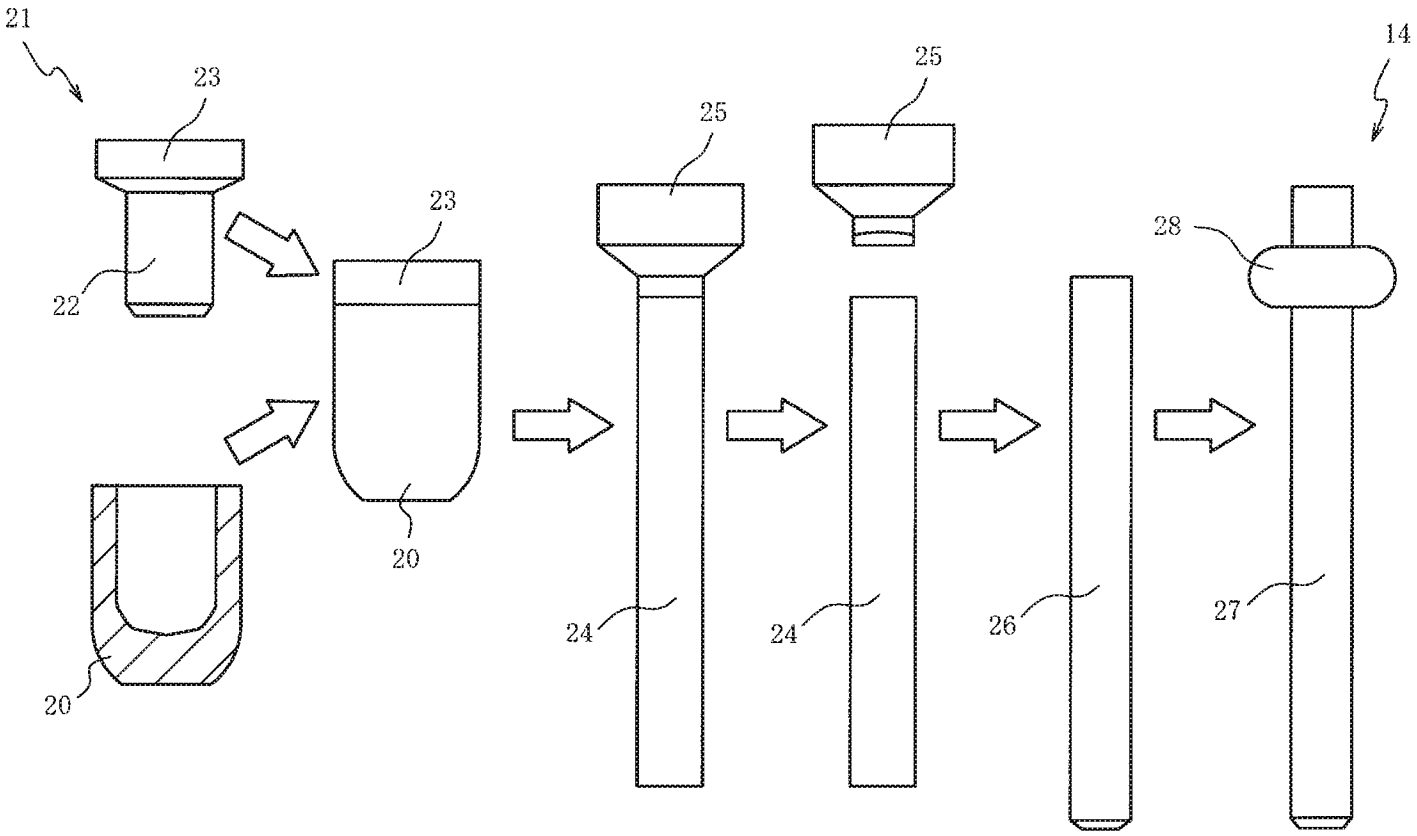
FIG. 2 is a schematic diagram showing a manufacturing process (second molding step) of a center electrode.

A method for manufacturing the center electrode 14 will be described with reference to FIG. 2. FIG. 2 is a schematic diagram showing a manufacturing process (second molding step of a spark plug electrode) of the center electrode 14. First, a cup-shaped molded product 20 serving as a raw material of the electrode base material 16 (see FIG. 1) and a columnar metal material 21 serving as a raw material of the core material 15 (see FIG. 1) are prepared. The metal material 21 includes a columnar portion 22, and a disk portion 23 having a larger outer diameter than the columnar portion 22. In the present embodiment, the outer diameter of the molded product 20 is not greater than 3.8 mm, and the wall thickness thereof in the radial direction is not greater than 0.5 mm.

After the molded product 20 is placed over the columnar portion 22 of the metal material 21, the molded product 20 and the metal material 21 are processed by cold forging so as to form a rod-shaped blank 24. After an end portion 25 that has not been fully processed is cut, a blank 26 whose diameter is further reduced than that of the blank 24 is formed. A shaft portion 27 is formed by further reducing the diameter of the blank 26, and a flange portion 28 is formed at an end of the shaft portion 27, to obtain a center electrode 14. The flange portion 28 is a portion for locking the center electrode 14 (spark plug electrode) to the insulator 13 (see FIG. 1).

Figure 3:
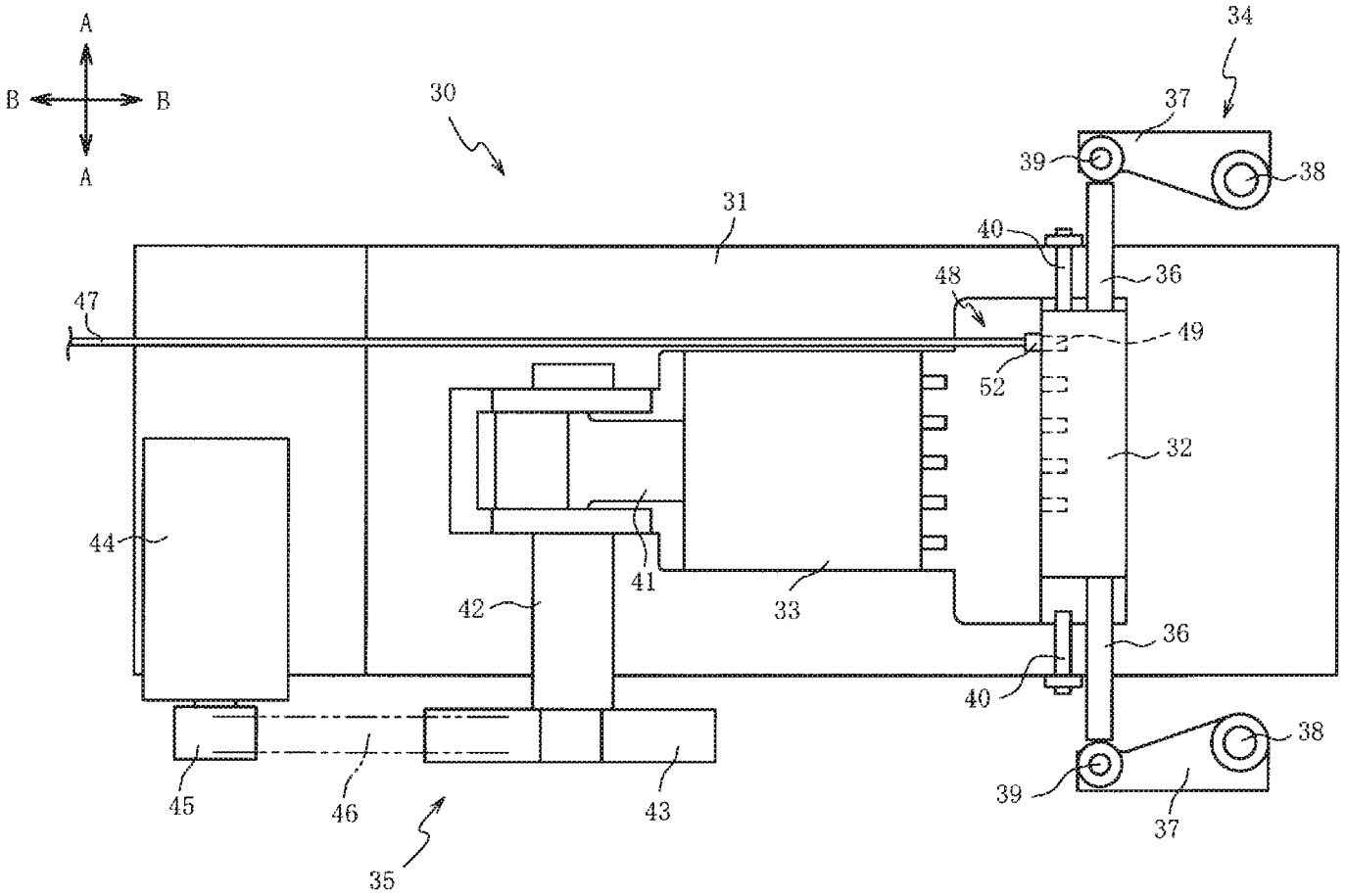
FIG. 3 is a top view of a processing apparatus according to an embodiment of the present invention.

A processing apparatus 30 that forms the molded product 20 will be described with reference to FIGS. 3 to 14. First, a schematic configuration of the processing apparatus 30 will be described with reference to FIG. 3. FIG. 3 is a top view of the processing apparatus 30 according to an embodiment of the present invention. Arrow heads A and arrow heads B in FIG. 3 indicate a first direction and a second direction, respectively. The processing apparatus 30 is an apparatus that forms the molded product 20 by processing a wire rod 47 in six stages.

In the processing apparatus 30, a die block 32 and a ram 33 are provided on a frame 31 so as to oppose each other. In the die block 32, a plurality of dies (described later) are arranged in a first direction (direction indicated by the arrow heads A) so as to be spaced apart from each other. In the ram 33, a plurality of punch blocks (described later) that oppose the plurality of dies are arranged in the first direction so as to be spaced apart from each other. A first moving portion 34 causes the die block 32 to reciprocate in the first direction. A second moving portion 35 causes the ram 33 to reciprocate in a second direction (direction indicated by the arrow heads B) intersecting the first direction.

The first moving portion 34 includes rods 36 and arms 37. The rods 36 are disposed on opposite sides of the die block 32 along the first direction. The arms 37 that are respectively disposed on opposite sides of the rods 36 so as to be spaced apart, from the die block 32 synchronously pivot about shafts 38 in the horizontal direction by power of a cam or the like (not shown). The arms are provided with, at end portions thereof, rollers 39 that respectively abut against the tips of the rods 36. Stoppers 40 define the limit of movement of the die block 32 in the first direction. When the arms 37 pivot about the shafts 38, the die block 32 reciprocates relative to the ram 33 in the first direction (the direction indicated by the arrow heads A).

The second moving portion 35 includes a crankshaft 42 and a motor 44. A connection rod 41 is coupled to the ram 33. The crankshaft 42 is mounted to the connection rod 41. The crankshaft 42 has a flywheel 43 mounted to an end portion thereof. A belt 46 spans across the flywheel 43 and a rotating wheel 45 that is fixed to the rotation shaft of the motor 44. Rotation of the motor 44 causes the flywheel 43 to rotate, so that the ram 33 moves forward and backward relative to the die block 32 in the second direction (the direction indicated by the arrow heads B).

The processing apparatus 30 includes a cutting portion 48 that cuts the wire rod 47 made of a metal. The cutting portion 48 includes a movable blade 49 provided on the die block 32, and a fixed blade 52 provided on the frame 31. The movable blade 49 reciprocates relative to the fixed blade 52 in the first direction. Either a coil material or a bar material can be used for the wire rod 47.

Figure 4:
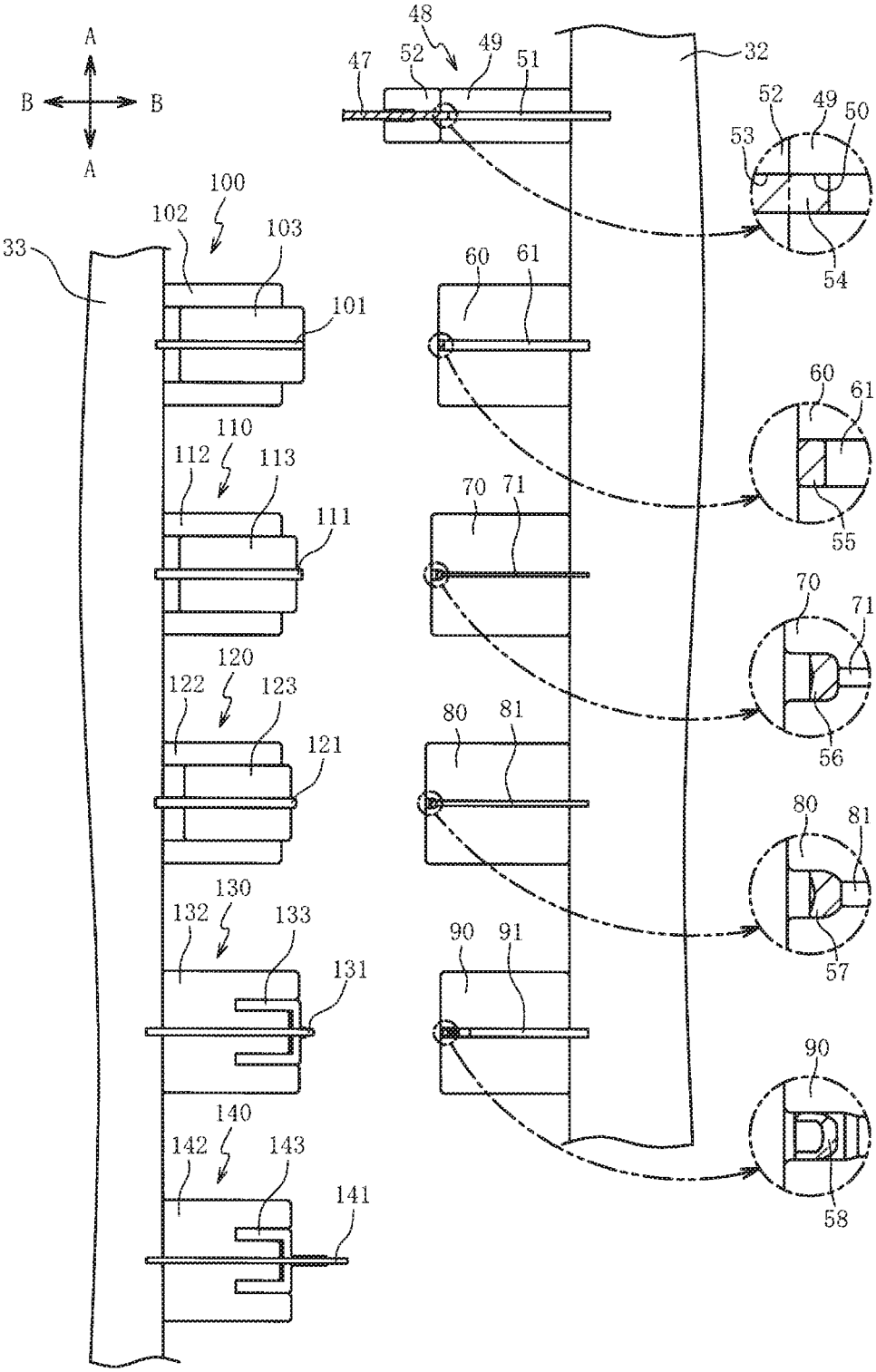
FIG. 4 is a schematic diagram of the processing apparatus.
Figure 10:
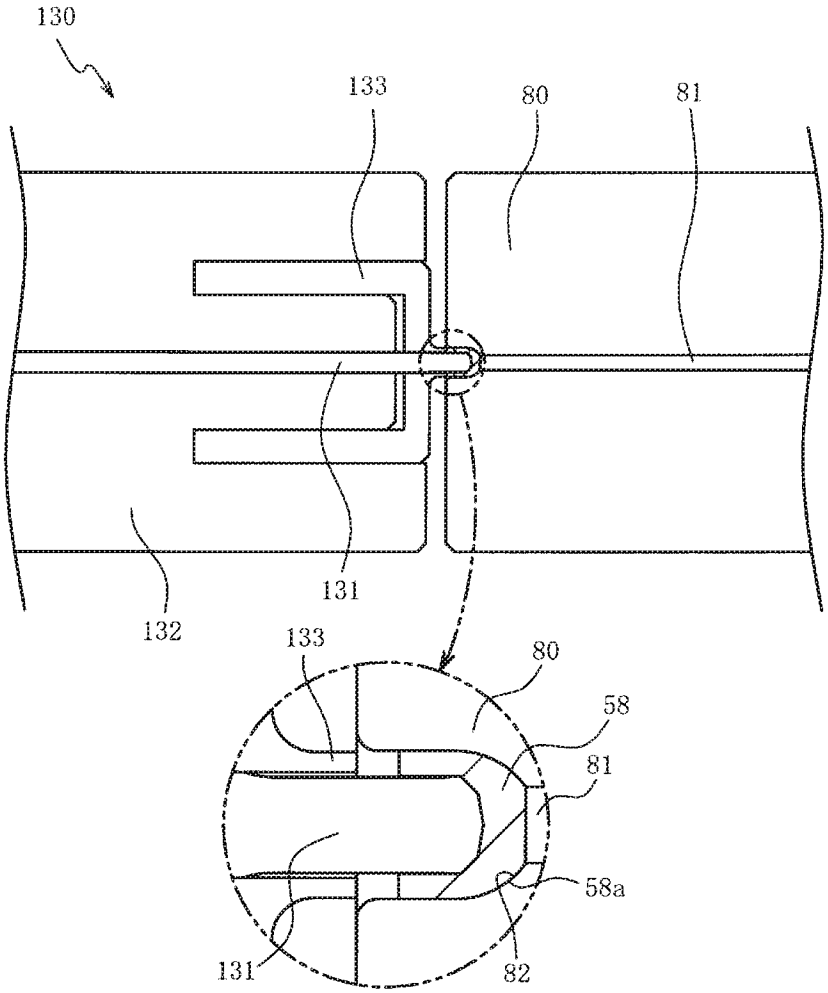
FIG. 10 is a schematic diagram of a fourth punch block and a third die.
Figure 11:
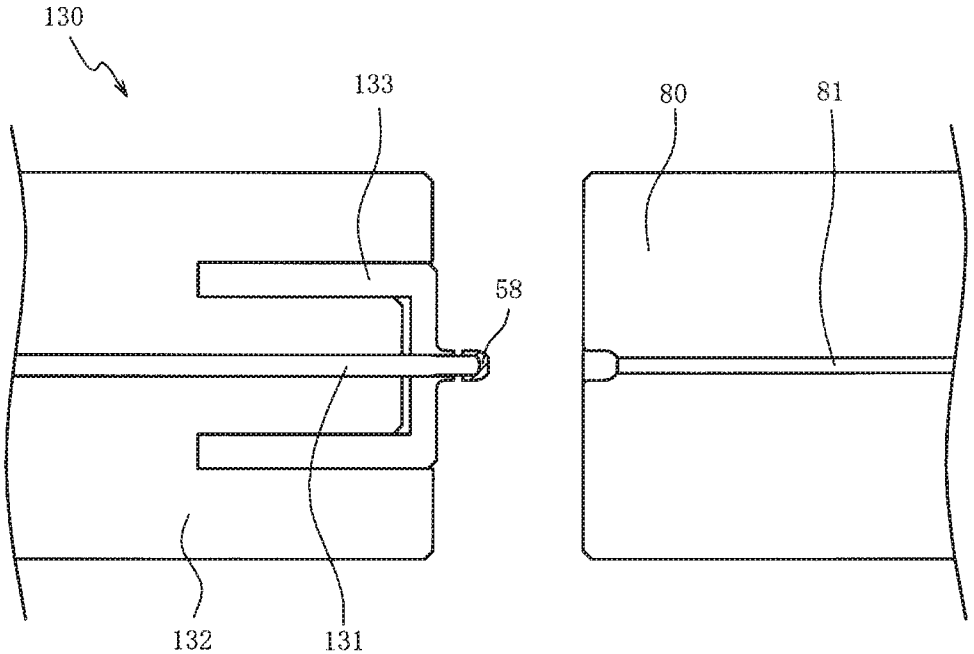
FIG. 11 is a schematic diagram of the fourth punch block and the third die.
Figure 12:
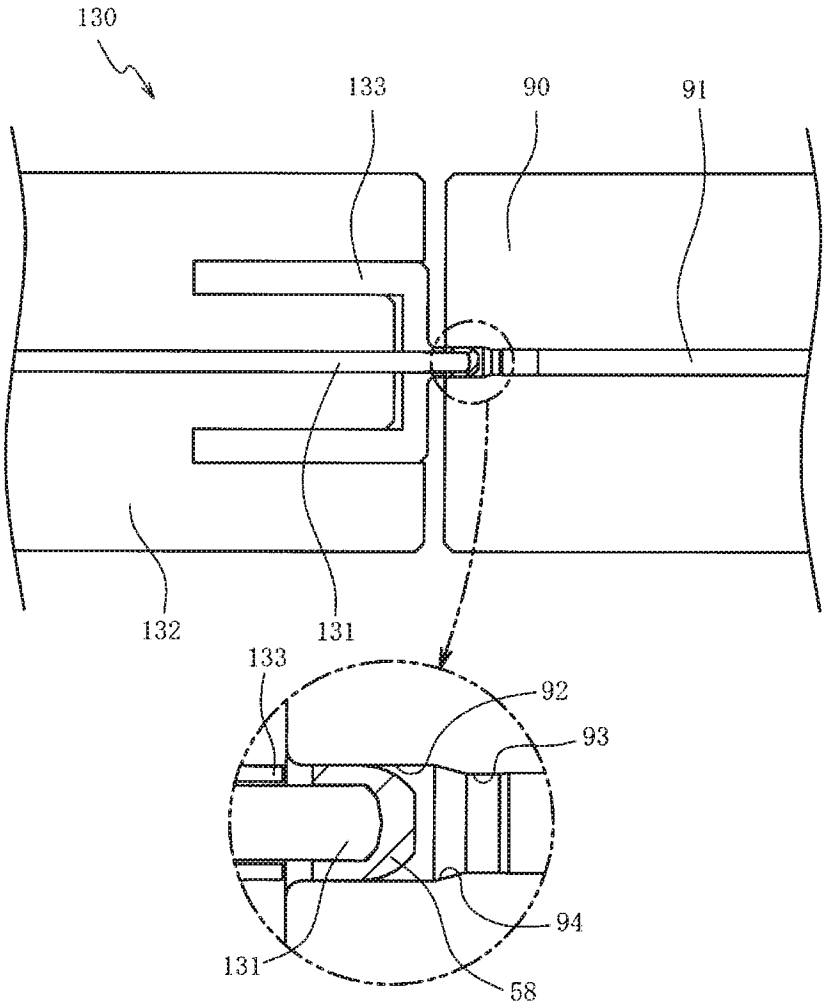
FIG. 12 is a schematic diagram of the fourth punch block and a fourth die.
Figure 13:
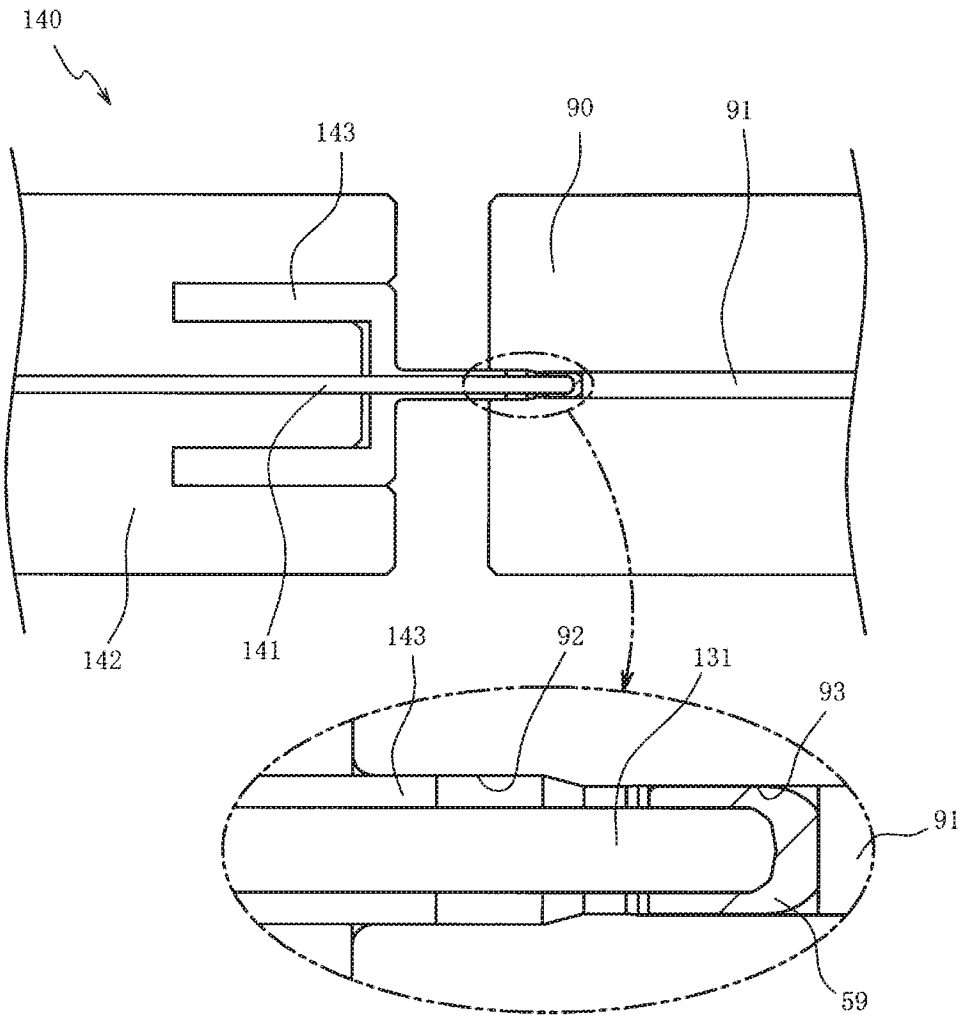
FIG. 13 is a schematic diagram of a fifth punch block and the fourth die.
Figure 14:
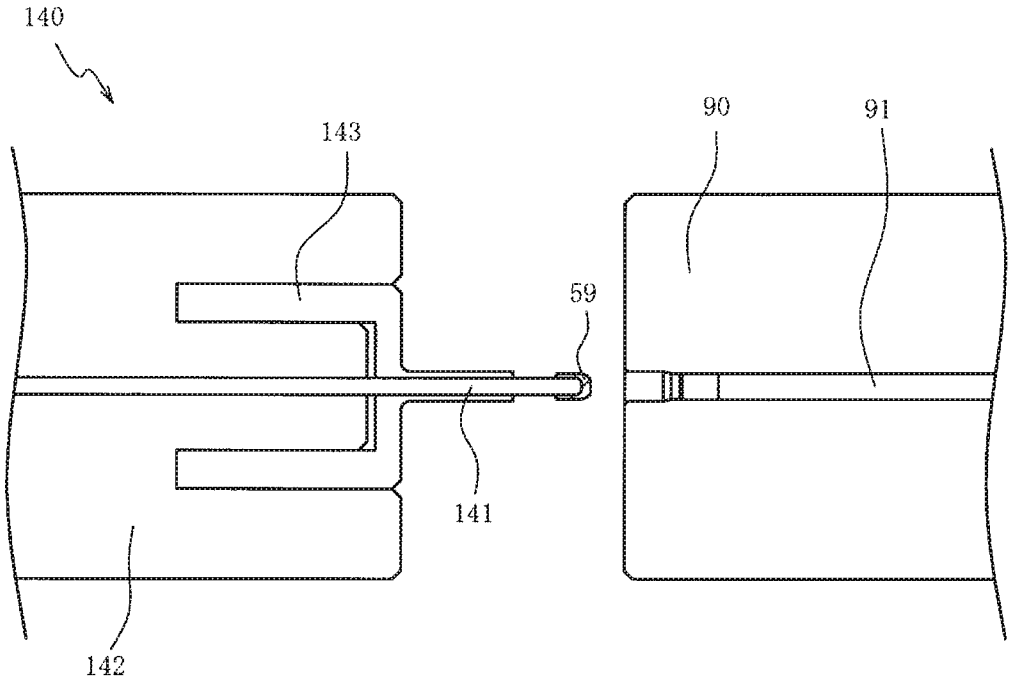
FIG. 14 is a schematic diagram of the fifth punch block and the fourth die.

FIG. 4 is a schematic diagram of the processing apparatus 30. FIGS. 5 to 9 are schematic diagrams of the processing apparatus 30, showing cutting steps. FIGS. 10 and 11 are schematic diagrams of a fourth punch block 130 and a third die 80. FIG. 12 is a schematic diagram of a fourth punch block 130 and a fourth die 90. FIGS. 13 and 14 are schematic diagrams of a fifth punch block 140 and the fourth die 90. FIGS. 4 to 9 illustrate a portion of the processing apparatus 30 that opposes the die block 32 and the ram 33. The arrow heads A and the arrow heads B in FIG. 4 indicate a first direction and a second direction, respectively.

As shown in FIG. 4, the die block 32 includes a movable blade 49, a first die 60, a second die 70, a third die 80, and a fourth die 90. The movable blade 49, the first die 60, the second die 70, the third die 80, and the fourth die 90 are disposed at the same pitch in the first direction.

The ram 33 includes a first punch block 100, a second punch block 110, a third punch block 120, a fourth punch block 130, and a fifth punch block 140. The first punch block 100, the second punch block 110, the third punch block 120, the fourth punch block 130, and the fifth punch block 140 are arranged at the same pitch as that of the movable blade 49, the first die 60, the second die 70, the third die 80, and the fourth die 90.

The movable blade 49 has a hole 50 penetrating the center thereof. The tip of the wire rod 47 is inserted through the hole 50 from the ram 33 side. A pin 51 that advances through the hole 50 to the ram 33 side is disposed in the movable blade 49. The pin 51 is moved by driving of an actuator (not shown). The fixed blade 52 has a hole 53 penetrating the center thereof. The movable blade 49 and the fixed blade 52 cut the wire rod 47 into a predetermined length so as to form a columnar first workpiece 54.

The first die 60 receives the load applied by a first punch 101 of the first punch block 100 by surrounding the first workpiece 54, thus molding a second workpiece 55. The second workpiece 55 is obtained by conditioning an end face of the first workpiece 54. A pin 61 that causes the molded second workpiece 55 to project to the ram 33 side is disposed in the first die 60. The pin 61 is moved by driving of an actuator (not shown).

The second die 70 receives the load applied by a second punch 111 of the second punch block 110 by surrounding the second workpiece 55, thus molding a third workpiece 56. A small indentation is formed on an end face of the third workpiece 56 by the second punch 111. A pin 71 that causes the molded third workpiece 56 to project to the ram 33 side is disposed in the second die 70. The pin 71 is moved by driving of an actuator (not shown).

The third die 80 receives the load applied by a third punch 121 of the third punch block 120 by surrounding the third workpiece 56, thus molding a fourth workpiece 57. A small indentation is formed on an end face of the fourth workpiece 57 by the third punch 121. In addition, the third die 80 receives the load applied by a fourth punch 131 of the fourth punch block 130 by surrounding the fourth workpiece 57, thus molding a fifth workpiece 58. A pin 81 that causes the molded fourth workpiece 57 and fifth workpiece 58 to project to the ram 33 side is disposed in the third die 80. The pin 81 is moved by driving of an actuator (not shown).

The fourth die 90 receives the load applied by a fifth punch 141 of the fifth punch block 140 by surrounding the fifth workpiece 58, thus molding a sixth workpiece 59 (to be described later), which is a molded product 20 having a complete shape. A pin 91 that causes the formed sixth workpiece 59 to project to the ram 33 side is disposed in the fourth die 90. The pin 91 is moved by driving of an actuator (not shown).

The first punch block 100 includes a case 102 that is fixed to the ram 33, and a guide 103 that guides the first punch 101 and moves forward and backward relative to the case 102. The first punch 101 and the guide 103 are moved by driving of an actuator (not shown).

The second punch block 110 includes a case 112 that is fixed to the ram 33, and a guide 113 that guides the second punch 111 and moves forward and backward relative to the case 112. The second punch 111 and the guide 113 are moved by driving of an actuator (not shown).

The third punch block 120 includes a case 122 that is fixed to the ram 33, and a guide 123 that guides the third punch 121 and moves forward and backward relative to the case 122. The third punch 121 and the guide 123 are moved by driving of an actuator (not shown).

Since the first punch 101, the second punch 111, and the third punch 121 are guided by the guides 103, 113, and 123, respectively, it is possible to reduce the amount of projection of the punches from the guides. As a result, it is possible to make the punches less likely to be broken.

The fourth punch block 130 includes a case 132 that is fixed to the ram 33, and a tubular movable stripper 133 that guides the fourth punch 131 and moves forward and backward relative to the case 132. The fourth punch 131 and the movable stripper 133 are moved by driving of an actuator (not shown). When the movable stripper 133 moves forward, the fifth workpiece 58 attached to the fourth punch 131 is removed from the fourth punch 131.

The fifth punch block 140 includes a case 142 that is fixed to the ram 33, and a tubular movable stripper 143 that guides the fifth punch 141 and moves forward and backward relative to the case 132. The fifth punch 141 and the movable stripper 143 are moved by driving of an actuator (not shown). When the movable stripper 143 moves forward, the sixth workpiece 59 attached to the fifth punch 141 is removed from the fifth punch 141.

Since the fourth punch 131 and the fifth punch 141 are guided by the tubular movable strippers 133 and 143, respectively, it is possible to reduce the amount of projection of the punches from the movable strippers 133 and 143. As a result, it is possible to make the punches less likely to be broken.

A method for manufacturing a molded product 20 (see FIG. 2) by using the processing apparatus 30 will be described in order, starting from FIG. 4. In FIG. 4, the movable blade 49 has been moved to a position directly facing (opposing) the fixed blade 52. In this state, the wire rod 47 passes through the hole 50, and a tip thereof enters the hole 53. The ram 33 is at a retracted position that is away from the die block 32.

Figure 5:
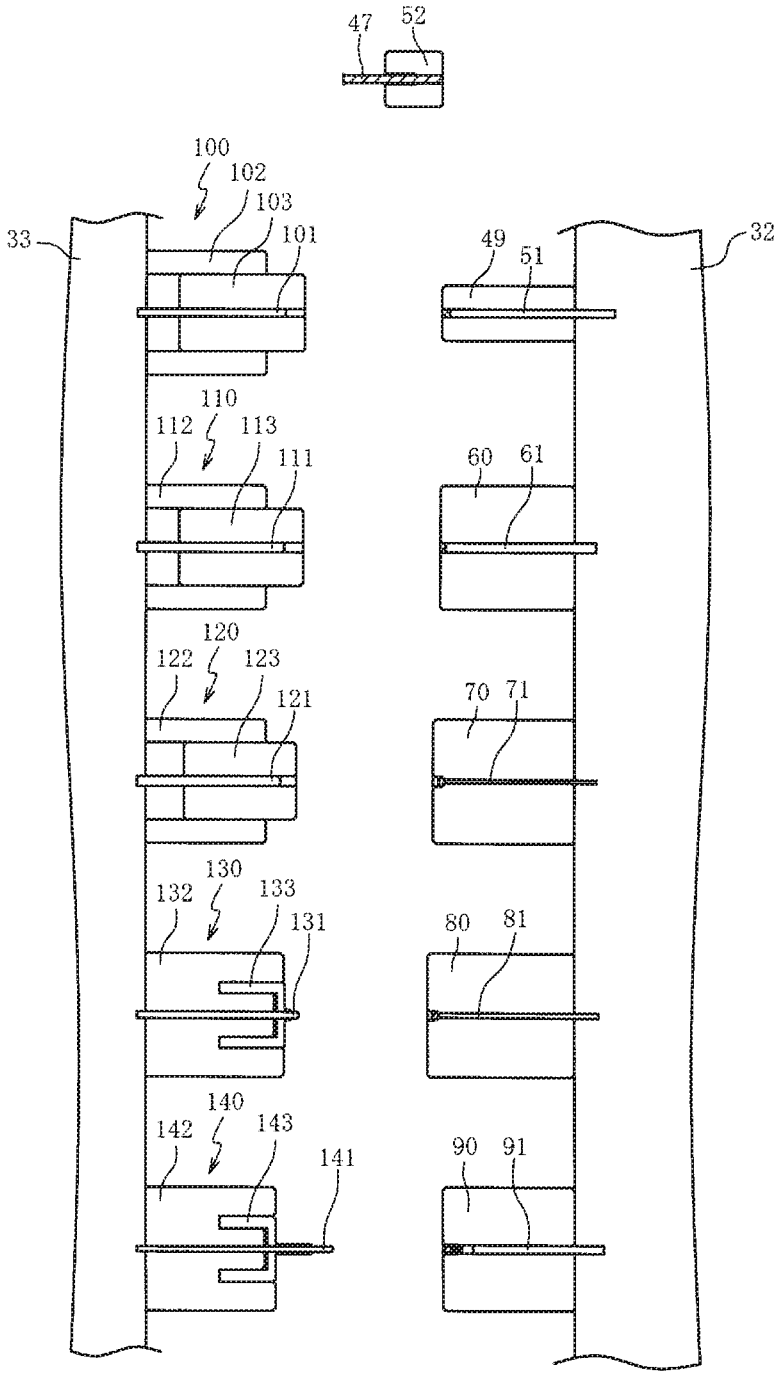
FIG. 5 is a schematic diagram of the processing apparatus, showing a cutting step.

Next, when the die block 32 moves by one pitch in the first direction (to the lower side in FIG. 5) as shown in FIG. 5, the wire rod 47 is cut by the fixed blade 52 and the movable blade 49, so that a columnar first workpiece 54 is molded. The movable blade 49 directly faces (opposes) the first punch 101 while holding the first workpiece 54 in the hole 50.

Figure 6:
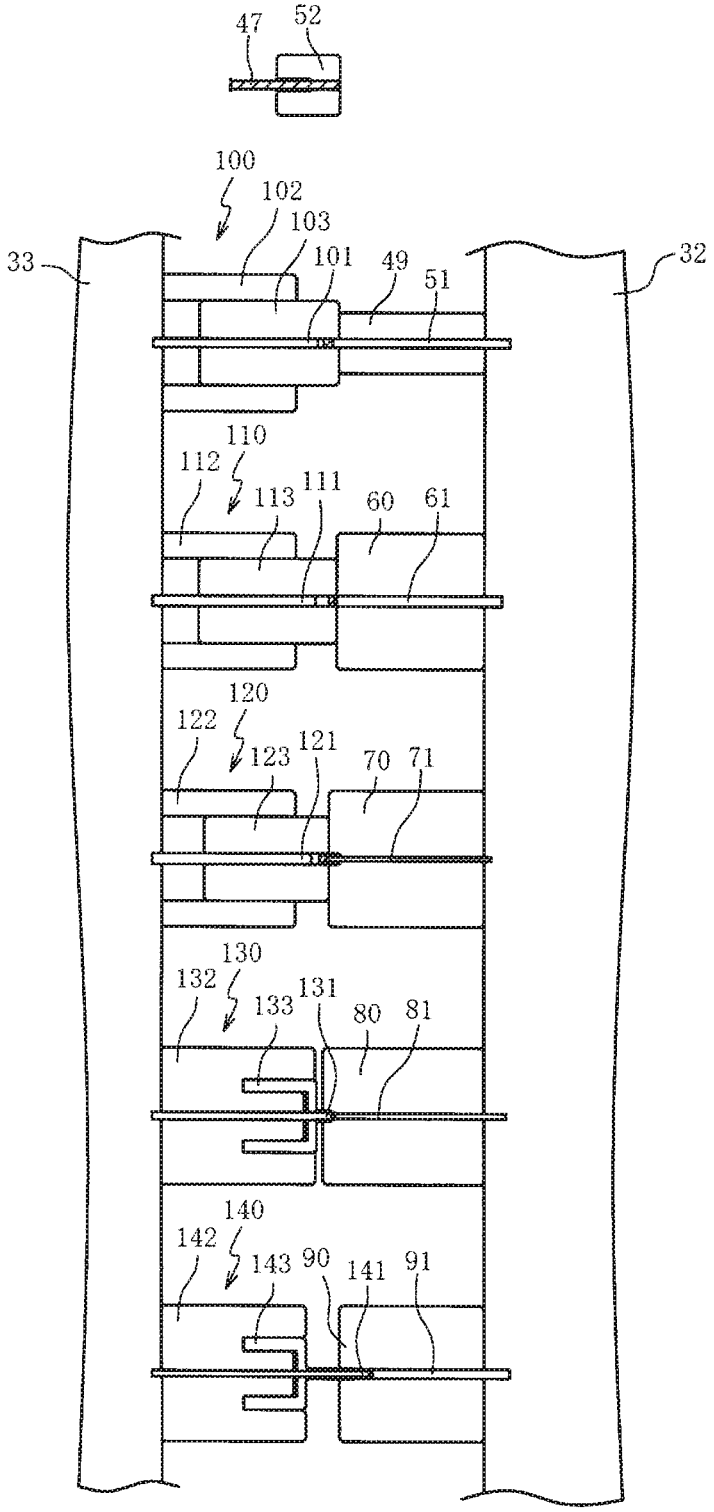
FIG. 6 is a schematic diagram of the processing apparatus, showing a molding step (first molding step).
Figure 7:
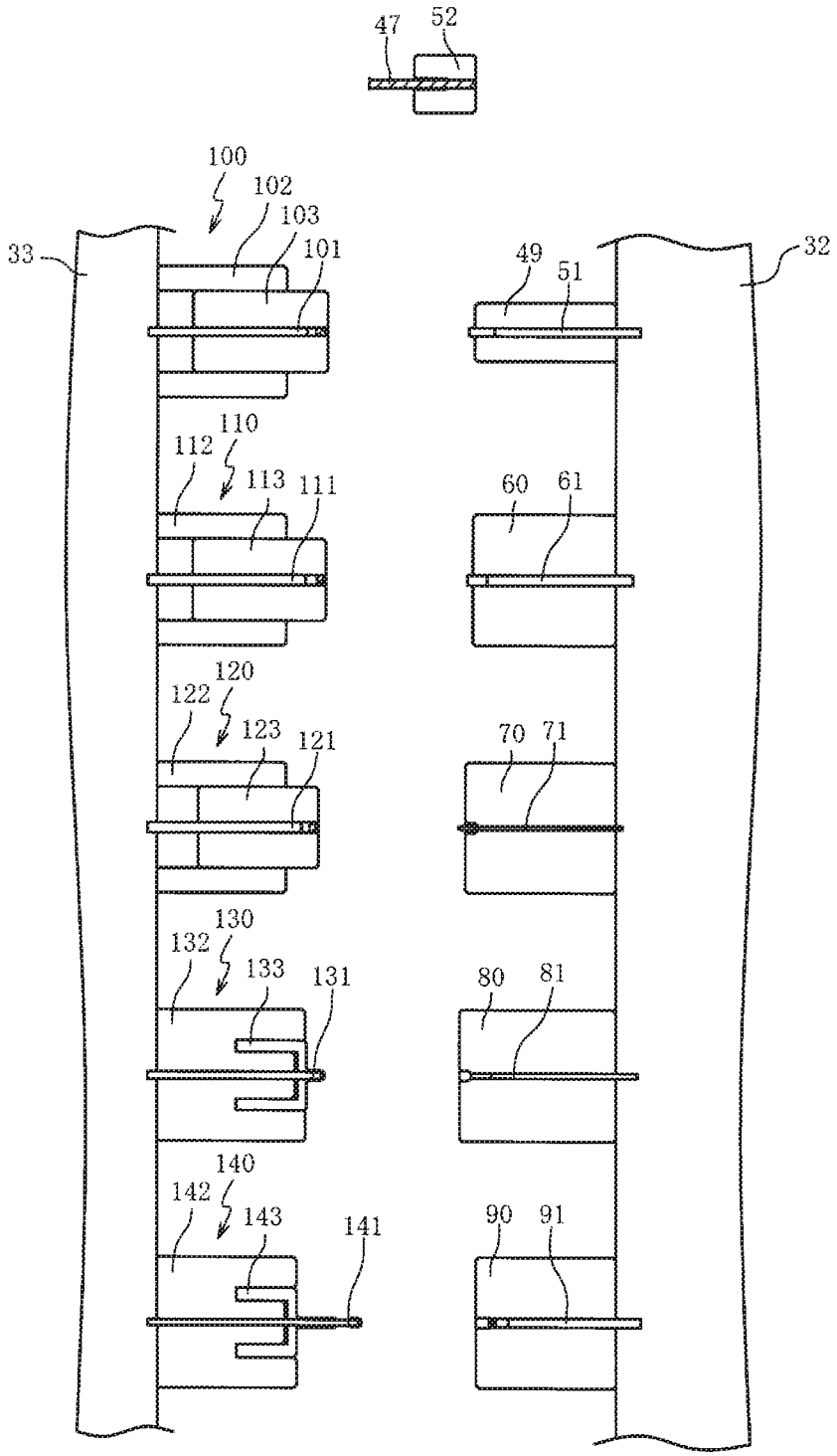
FIG. 7 is a schematic diagram of the processing apparatus, showing a molding step.

Next, the ram 33 moves forward toward the die block 32 as shown in FIG. 6, and the first punch block 100 causes the guide 103 to abut against the movable blade 49. The pin 51 of the movable blade 49 moves forward to the ram 33 side, and the first workpiece 54 is projected by the pin 51 so as to be transferred from the movable blade 49 to the first punch block 100. Then, as shown in FIG. 7, the ram 33 moves backward so as to be away from the die block 32.

Figure 8:
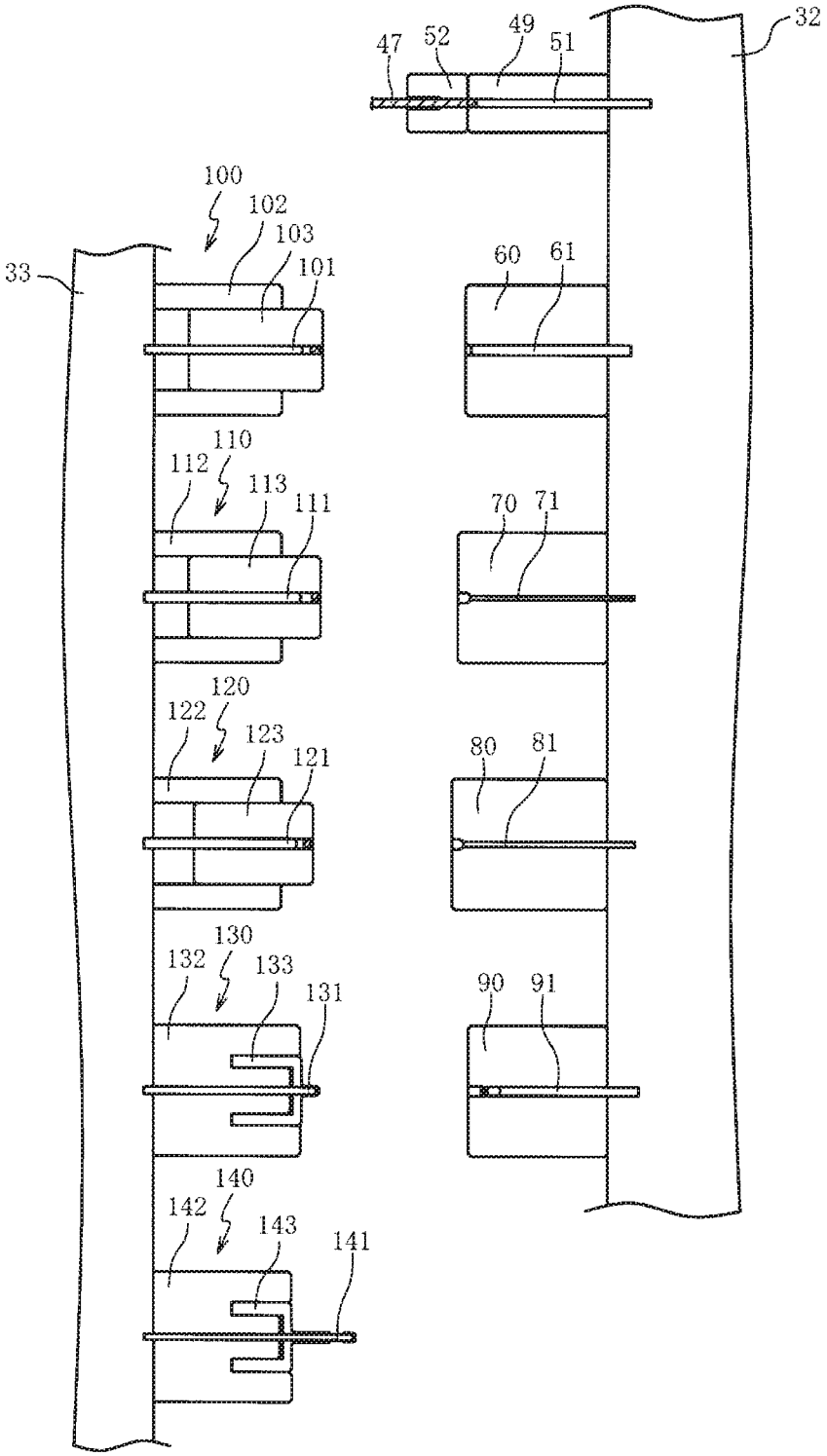
FIG. 8 is a schematic diagram of the processing apparatus, showing a molding step.

Next, the die block 32 moves by one pitch toward the first direction (the upper side in FIG. 8) on the fixed blade 52 side as shown in FIG. 8, and the movable blade 49 directly faces the fixed blade 52 again. The first punch block 100 holding the first workpiece 54 directly faces the first die 60.

Figure 9:
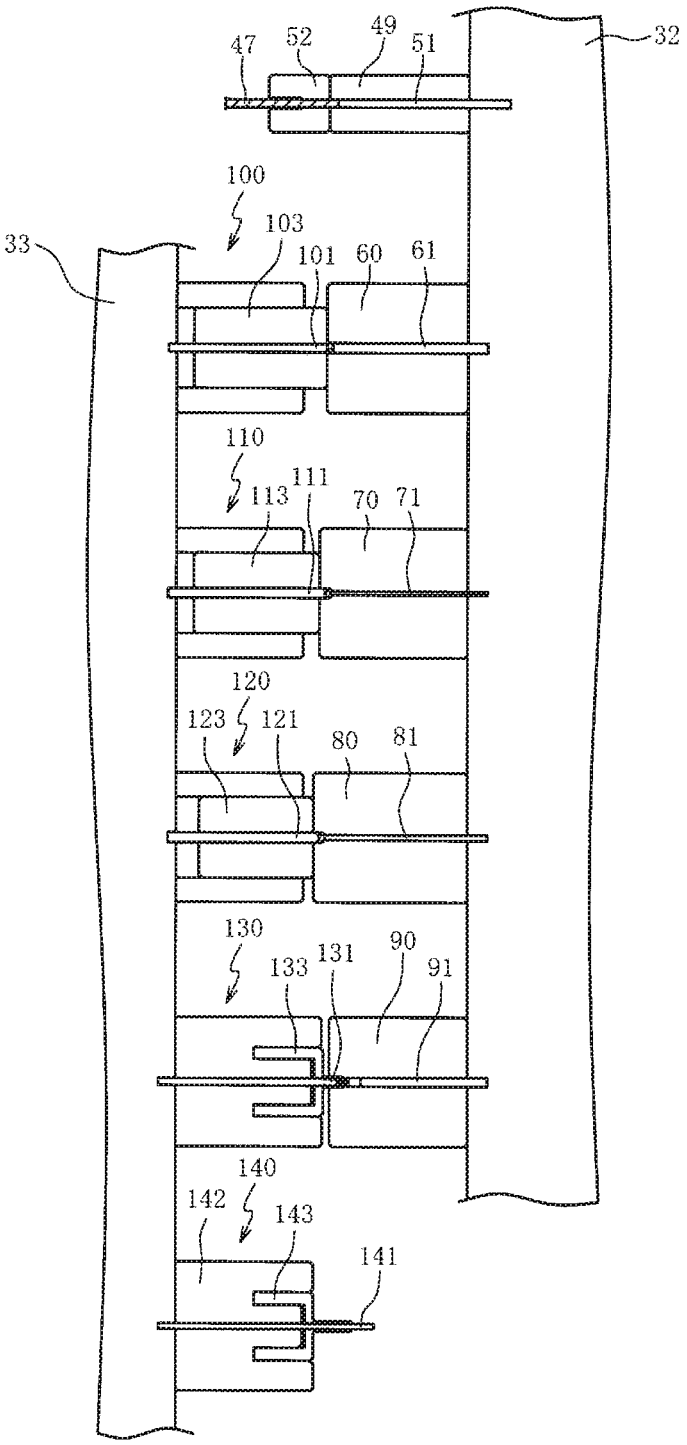
FIG. 9 is a schematic diagram of the processing apparatus, showing a molding step.

Next, the ram 33 moves forward toward the die block 32 as shown in FIG. 9, and the first punch 101 and the first die 60 impart impact to the first workpiece 54. Consequently, a second workpiece 55 (see FIG. 4) is molded. In addition, the tip of the wire rod 47 enters into the movable blade 49.

Then, the ram 33 moves backward so as to be away from the die block 32 as shown in FIG. 4, and thereafter, the die block 32 moves by one pitch in the first direction (to the lower side in FIG. 5) as shown in FIG. 5. The first die 60 directly faces the second punch 111 while holding the second workpiece 55.

As shown in FIG. 6, the ram 33 moves forward toward the die block 32, and the second punch block 110 causes the guide 113 to abut against the first die 60. The pin 61 of the first die 60 moves forward to the ram 33 side, and the second workpiece 55 is caused to project by the pin 61 so as to be transferred from the first die 60 to the second punch block 110. Then, as shown in FIG. 7, the ram 33 moves backward so as to be away from the die block 32.

As shown in FIG. 8, the die block 32 moves by one pitch toward the first direction (the upper side in FIG. 8) on the fixed blade 52 side, and the second punch block 110 holding the second workpiece 55 directly faces the second die 70. As shown in FIG. 9, the ram 33 moves forward toward the die block 32, and the second punch 111 and the second die 70 impart impact to the second workpiece 55. Consequently, a third workpiece 56 (see FIG. 4) is molded.

Then, the ram 33 move backward so as to be away from the die block 32 as shown in FIG. 4, and the die block 32 moves by one pitch in the first direction (to the lower side in FIG. 5) as shown in FIG. 5. The second die 70 directly faces the third punch 121 while holding the third workpiece 56.

As shown in FIG. 6, the ram 33 moves forward toward the die block 32, and the third punch block 120 causes the guide 123 to abut against the second die 70. The pin 71 of the second die 70 moves forward to the ram 33 side, and the third workpiece 56 is caused to project by the pin 71 so as to be transferred from the second die 70 to the third punch block 120. Then, as shown in FIG. 7, the ram 33 moves backward so as to be away from the die block 32.

As shown in FIG. 8, the die block 32 moves by one pitch toward the first direction (the upper side in FIG. 8) on the fixed blade 52 side, and the third punch block 120 holding the third workpiece 56 directly faces the third die 80. As shown in FIG. 9, the ram 33 moves forward toward the die block 32, and the third punch 121 and the third die 80 impart impact to the third workpiece 56. Consequently, a fourth workpiece 57 (see FIG. 4) is molded.

Then, the ram 33 move backward so as to be away from the die block 32 as shown in FIG. 4, and thereafter, the die block 32 moves by one pitch in the first direction (to the lower side in FIG. 5) as shown in FIG. 5. The third die 80 directly faces the fourth punch 131 while holding the fourth workpiece 57. As shown in FIG. 6, the ram 33 moves forward toward the die block 32, and the fourth punch 131 and the third die 80 impart impact to the fourth workpiece 57. Consequently, a fifth workpiece 58 (see FIG. 10) is formed.

As shown in FIG. 10, the third die 80 is a recessed die for molding the fifth workpiece 58 having the bottomed tubular shape. A corner portion 82 that forms a round portion at an edged portion 58*a* at the bottom of the fifth workpiece 58 is provided around the entire perimeter of the third die 80. Due to the provision of the corner portion 82, any material that has moved during molding of the fifth workpiece 58 can easily flow into a clearance between the outer periphery of the fourth punch 131 and the inner periphery of the third die 80. As a result, the fifth workpiece 58 tightens the fourth punch 131.

If the fifth workpiece 58 is caused to project by the pin 81 when the die block 32 moves backward so as to be away from the ram 33, the fourth punch 131 exits from the third die 80 with the fifth workpiece 58 being attached thereto, together with the fifth workpiece 58, as shown in FIG. 11. Since the fifth workpiece 58 tightens the fourth punch 131, it is possible to prevent the fifth workpiece 58 from being detached from the fourth punch 131.

In order for the fifth workpiece 58 to be released from the third die 80 while being attached to the fourth punch 131, it is preferable that the frictional force received by the fifth workpiece 58 from the third die 80 is set to be smaller than the frictional force received by the fifth workpiece 58 from the fourth punch 131. Since the corner portion 82 (rounded portion) is formed on the third die 80, it is possible to reduce the vertical drag (a constituent vertical to the axis of the fourth punch 131) by the provision of the corner portion 82 as compared to a die on which the corner portion 82 is not formed. As a result, the frictional force (a product of the vertical drag and the coefficient of friction) received by the fifth workpiece 58 from the third die 80 can be reduced as compared to a die on which the corner portion 82 into formed. Accordingly, the fifth workpiece 58 can be easily attached to the fourth punch 131.

Furthermore, the drag applied to the fifth workpiece 58 by the corner portion 82 of the third die 80 has a component in a releasing direction (leftward in FIG. 10) that is parallel to the axis of the fourth punch 131. The frictional force received by the fifth workpiece 58 from the third die 80 can be reduced by an amount corresponding to the component, so that the fifth workpiece 58 can be easily released from the third die 80 while being attached to the fourth punch 131.

Then, as shown in FIG. 8, the die block 32 moves by one pitch toward the first direction (the upper side in FIG. 8) on the fixed blade 52 side, and the fourth punch 131 holding the fifth workpiece 58 directly faces the fourth die 90. As shown in FIG. 9, the ram 33 moves forward toward the die block 32, and the fourth punch 131 inserts the fifth workpiece 58 into the fourth die 90 (see FIG. 12).

As shown in FIG. 12, the fourth die 90 is a die for forming a molded product 20 (see FIG. 2) having a final shape. The fourth die 90 includes a cylindrical first portion 92 into which the fifth workpiece 58 is inserted, a cylindrical second portion 93 formed to have the inner diameter of the final shape, and a conical inclined portion 94 that connects the second portion 93 and the first portion 92. The inner diameter of the first portion 92 is set to be substantially the same as the outer diameter of the fifth workpiece 58.

In a state in which the fifth workpiece 58 is inserted in the first portion 92 of the fourth die 90, the fourth punch block 130 drives an actuator (not shown) to move the movable stripper 133 forward. The movable stripper 133 pushes out the fifth workpiece 58 attached to the fourth punch 131 with its tip entering the first portion 92 of the fourth die 90, thus removing the fifth workpiece 58 from the fourth punch 131.

Then, after the ram 33 has moved backward so as to be away from the die block 32 as shown in FIG. 4, the die block 32 moves by one pitch in the first direction (to the lower side in 5) as shown in FIG. 5. The fourth die 90 directly faces the fifth punch 141 while holding the fifth workpiece 58. As shown in FIG. 6, the ram 33 moves forward toward the die block 32, and the fifth punch 141 and the fourth die 90 impart impact to the fifth workpiece 58. A sixth workpiece 59 (see FIG. 13) is molded by the inclined portion 94 of the fourth die 90, the second portion 93, and the fifth punch 141.

If the sixth workpiece 59 is caused to project by the pin 91 when the ram 33 moves backward so as to be away from the die block 32, the fifth punch 141 exits from the fourth die 90 with the sixth workpiece 59 being attached thereto, together with the sixth workpiece 59, as shown in FIG. 14. The fifth punch block 140 drives an actuator (not shown) to move the movable stripper 143 forward. The movable stripper 143 pushes out the sixth workpiece 59 attached to the fifth punch 141, thus removing the sixth workpiece 59 from the fifth punch 141. Consequently, the sixth workpiece 59 (molded product 20) having the final shape is obtained.

With the processing apparatus 30, the fourth punch 131 and the die block 32 that reciprocates in the first direction in which the dies are arranged move the workpiece from upstream to downstream of the working process. Accordingly, it is possible to eliminate the need for fingers used in the conventional processing apparatuses. Since the length of the punches of the fourth punch 131 and the like can be shortened by omission of the fingers, it is possible to inhibit breakage of the punches.

The third die 80 (recessed die) molds the fifth workpiece 58 into the bottomed tubular shape by the fourth punch 131. After molding, the fourth punch 131 exits from the third die 80 with the molded fifth workpiece 58 being attached thereto, together with the fifth workpiece 58. Since the workpiece is transferred from the die block 32 to the ram 33 when the fourth punch 131 exits from the third die 80, the step of moving the ram 33 forward relative to the die block 32 to transfer the workpiece from the die block 32 to the ram 33 can be omitted accordingly. Therefore, the working process can be shortened.

Since a round portion is formed at the edged portion 58*a* at the bottom of the fifth workpiece 58 by the corner portion 82 of the third die 80 (recessed die), any material that has moved during molding of the fifth workpiece 58 can easily flow into a clearance between the outer periphery of the fourth punch 131 and the inner periphery of the third die 80. As a result, a material flow that causes the fifth workpiece 58 to tighten the fourth punch 131 occurs. Since the fifth workpiece 58 can be easily attached to the fourth punch 131, the fifth workpiece 58 can easily exit from the third die 80 together with the fourth punch 131. In addition, it is possible to prevent the fifth workpiece 58 from being detached during transportation of the fifth workpiece 58 by the fourth punch 131.

The movable stripper 133 disposed on the outer periphery of the fourth punch 131 is in the retracted state when the fourth punch 131 enters the third die 80 so as to form the fifth workpiece 58. Accordingly, it is possible to prevent the movable stripper 133 from adversely affecting molding of the fifth workpiece 58. The movable stripper 133 moves forward toward the tip of the fourth punch 131 when the fourth punch 131 enters the fourth die 90 with the fifth workpiece 58 being attached thereto. This makes it possible to remove the fifth workpiece 58 from the fourth punch 131, and place the fifth workpiece 58 in the fourth die 90. The fifth workpiece 58 placed in the fourth die 90 is impacted on by the fifth punch 141. Since whether to transport or impact on the workpiece can be switched according to the position of the movable stripper 133, it is possible to enhance the design freedom of the working process.

As described above, although the present invention has been described based on the embodiments, the present invention is not limited to the above embodiments at all. It can be easily understood that various modifications can be devised without departing from the gist of the present invention. For example, the number of dies provided in the die block 32 and the number of punches provided in the ram 33 are exemplary, and may be set as appropriate.

The above embodiment has described the processing apparatus 30 that obtains the molded product 20 made of a metal by processing the wire rod 47 made of a metal. However, the present invention is not necessarily limited thereto. It is of course possible to apply the above embodiment to a processing apparatus that obtains a molded product made of a synthetic resin by processing a wire rod made of a synthetic resin.

The above embodiment has described a case where the third die 80 and the fourth punch 131 are provided as a die and a punch that transport a workpiece having a bottomed tubular shape in the working process up to the molding of the sixth workpiece 58 having a final shape. However, the present invention is not necessarily limited thereto. The number of sets of dies and punches that transport the workpiece having the bottomed tubular shape is not limited to one, and it is of course possible to provide a plurality of sets of such dies and punches in accordance with the working process.

The above embodiment has described a case where the die block 32 is reciprocated on a pitch-by-pitch basis in the first direction, and the ram 33 is moved forward and backward relative to the die block 32. However, the present invention is not necessarily limited thereto. Conversely, it is of course possible to reciprocate the ram 33 on a pitch-by-pitch basis in the first direction, and move the die block 32 forward and backward relative to the ram 33. In this case, the movable blade 49 may be provided in the ram 33, and the wire rod 47 may be supplied from the die block 32 side.

DESCRIPTION OF REFERENCE NUMERALS

14: center electrode (spark plug electrode);
20: molded product;
21: metal material;
30: processing apparatus;
32: die block;
33: ram;
34: first moving portion;
35: second moving portion;
47: wire rod;
48: cutting portion;
54: first workpiece (workpiece);
55: second workpiece (workpiece);
56: third workpiece (workpiece);
57: fourth workpiece (workpiece);
58: fifth workpiece (workpiece);
58*a*: edged portion;
59: sixth workpiece (workpiece);
80: third die (recessed die);
82: corner portion;
131: fourth punch (punch);
133: movable stripper
141: fifth punch Having described the invention, the following is claimed:

1. A processing apparatus comprising:

a cutting portion that cuts a wire rod to produce a workpiece;

a die block in which a plurality of dies that receive the workpiece are arranged so as to be spaced apart from each other;

a ram in which a plurality of punches that oppose the plurality of dies are arranged so as to be spaced apart from each other;

a first moving portion that relatively moves the ram and the die block in a first direction in which the dies and the punches are arranged; and a second moving portion that relatively advances and retracts the ram and the die block in a second direction intersecting the first direction, wherein the workpiece is processed by transferring the workpiece between the ram and the die block, wherein at least one of the plurality of dies includes a recessed die that is configured to mold the workpiece into a bottomed tubular shape by a corresponding one of the punches, wherein the corresponding one of the punches, among the plurality of punches, that has entered the recessed die is configured to exit the recessed die with the molded workpiece being attached to the corresponding one of the punches, together with the workpiece, wherein the ram includes a movable stripper respectively disposed on an outer periphery of the corresponding one of the punches, among the plurality of punches, that enters the recessed die, wherein the moveable stripper is in a retracted state when the corresponding one of the punches enters the recessed die to mold the workpiece, and wherein the moveable stripper is configured to advance toward a tip of the corresponding one of the punches when the corresponding one of the punches enters one of the dies that is different from the recessed die, with the workpiece being attached to the corresponding one of the punches.

2. The processing apparatus according to claim 1, wherein the recessed die includes a corner portion that forms a round portion at an edged portion at a bottom of the workpiece.

* * * * *